United States Patent [19]

Van House

[11] 4,041,927

[45] Aug. 16, 1977

[54] ARCHERY BOW WITH PIVOTED BOW LIMBS HAVING ROTATIONAL SYNCHRONIZER AND ADJUSTABLE DRAW FORCE MECHANISMS

[76] Inventor: Robert M. Van House, 268 Enfield Road, Dayton, Ohio 45459

[21] Appl. No.: 598,569

[22] Filed: July 24, 1975

[51] Int. Cl.[2] ..... F41B 11/00

[52] U.S. Cl. ..... 124/61; 124/24 R; 124/16

[58] Field of Search ..... 124/24 R, 23 R, 35 A, 124/30 R, 25, 17, 30 A, 13 R, 88, 86, 26, 61, 63; 272/79 C, 16; 267/65, 124, 174

[56] References Cited

U.S. PATENT DOCUMENTS

| | | | |
|---|---|---|---|
| 2,714,377 | 8/1955 | Mulkey | 124/24 R |
| 3,128,094 | 4/1964 | Wolf | 272/79 C |
| 3,518,980 | 7/1970 | Hamm | 124/24 R X |
| 3,744,473 | 7/1973 | Nishioka | 124/24 R |
| 3,812,835 | 5/1974 | Smith | 124/24 R |

*Primary Examiner*—Richard C. Pinkham
*Assistant Examiner*—William R. Browne
*Attorney, Agent, or Firm*—Jacox & Meckstroth

[57] ABSTRACT

An archery bow which uses a single adjustable load spring instead of the usual pair of flexible bow limbs as the resilient energy medium. Bow limbs which are relatively rigid are pivoted on the handle section and are coupled together and synchronized in travel rate and equalized in forces by a single synchronizing linkage. A single adjustable ratio changing mechanism is used to provide a high mid draw force and a low full draw force and include structure to change the draw distance at which these draw forces occur.

These three features: a single adjustable spring, a single synchronizing mechanism and a single adjustable ratio changing mechanism make the bow highly efficient, easy to hold at full draw and readily adjustable for short or tall, weak or strong archers.

13 Claims, 8 Drawing Figures

ARCHERY BOW WITH PIVOTED BOW LIMBS HAVING ROTATIONAL SYNCHRONIZER AND ADJUSTABLE DRAW FORCE MECHANISMS

BACKGROUND OF THE INVENTION

This invention relates to archery bows which have a broad range of adjustment; making a single bow adaptable to a child or a strong grown man. Bows are generally selected by reference to a draw force rating. A bow with a low draw force is used by a child, a moderate draw force for an adult target bow and a high draw force for a hunting bow.

Recent improvements in bows, such as described in U.S. Pat. No. 3,486,495, have resulted in bows which have a draw force at full draw which is somewhat less than the draw force at mid draw. This is a valuable feature, however it has made it more difficult to fit a bow to a given archer because different draw distance capabilities, as well as different draw force needs, require a different bow. This shortcoming has been partially met by providing interchangeable components attached to each bow limb to fit a bow to a particular archer's requirements. These interchangeable components include cams which must be carefully matched and carefully synchronized with each other in order to have equal forces and equal velocities in each bow limb. Limitations on the ability to accurately synchronize the two bow limbs limits the magnitude of the drop in draw force at full draw that can be practically accomplished.

SUMMARY OF THE INVENTION

A primary object of this invention is to provide a high efficiency archery bow which is universal in usage. It will have simple adjustments to make the bow suitable for a child or an adult and will simultaneously provide near optimum characteristics for target or hunting purposes.

A further objective is to provide a bow having relatively rigid bow limbs pivoted to a central handle section. The two bow limbs being mechanically coupled together; so that their forces and velocities are identical. With rigid limbs mechanically coupled together, there is no chance of poor synchronization between the two limbs as there is with more conventional bows.

Another objective is to power these relatively rigid limbs with a single spring which can be easily adjusted in force. Bow draw force can thus be modified to nearly any desired level by changing the characteristics of this single spring unit.

A further objective is to provide a single ratio changeing mechanism between the single spring and the bow limbs. A single ratio changing mechanism, instead of the two used in other bows, is possible because there is only one spring and the limbs are coupled together with a synchronizing mechanism. This ratio changing mechanism can be one of many well known forms which can be tailored to provide high draw forces at mid draw and low forces at full draw. In fact, designs will be described which will permit the draw force to drop to zero at full draw. Extreme modification of draw force is practical because the single spring and coupled rigid bow limbs provide perfect synchronization of bow limb action.

A final objective is to provide means to shift the relationship between draw distance and mechanical advantage of the ratio changing mechanism with a simple adjustment. This shift permits tailoring the draw force/- draw distance characteristics of the bow, so the drop in draw force can occur at a short draw distance or at a long draw distance. The bow can thus be adjusted for the draw distance needs for a child or a tall adult.

These and other objects of the invention will become apparent as the detailed description of the invention proceeds.

DESCRIPTION OF THE PREFERRED EMBODIMENTS

Figure 1:
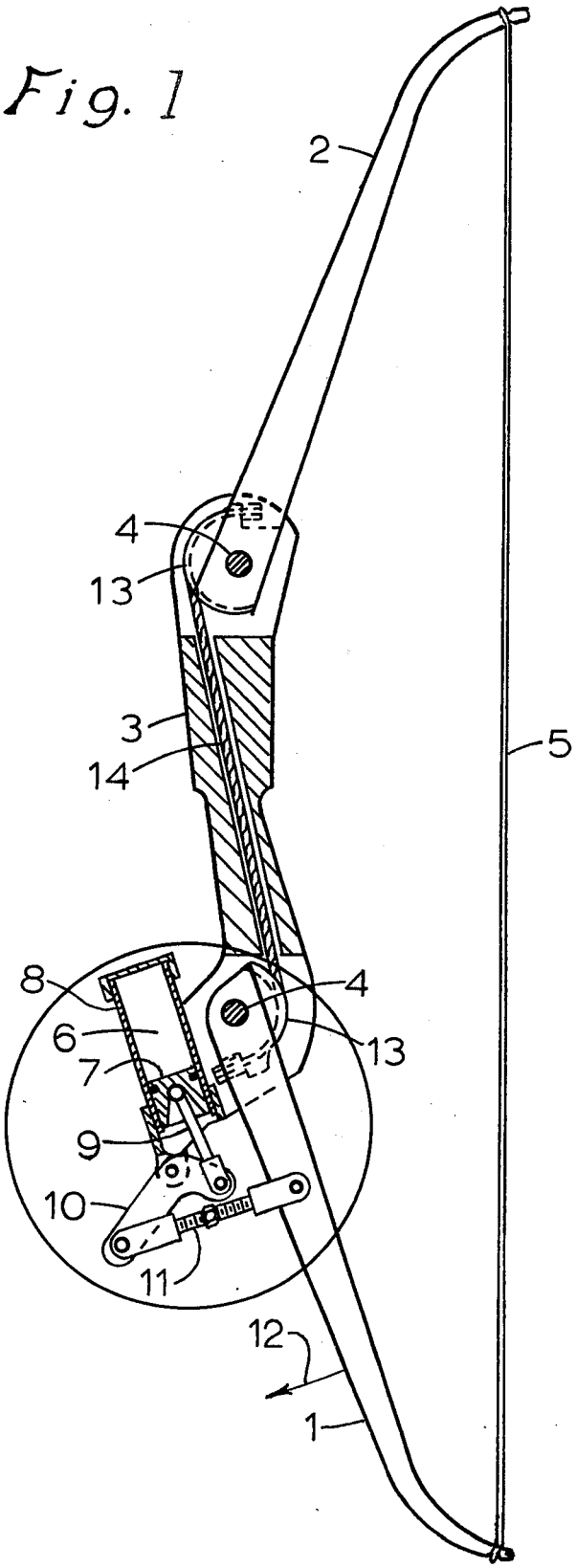
FIG. 1 is a side view of the bow of this invention, with parts shown in section. The bow is shown in the braced position.
Figure 1A:
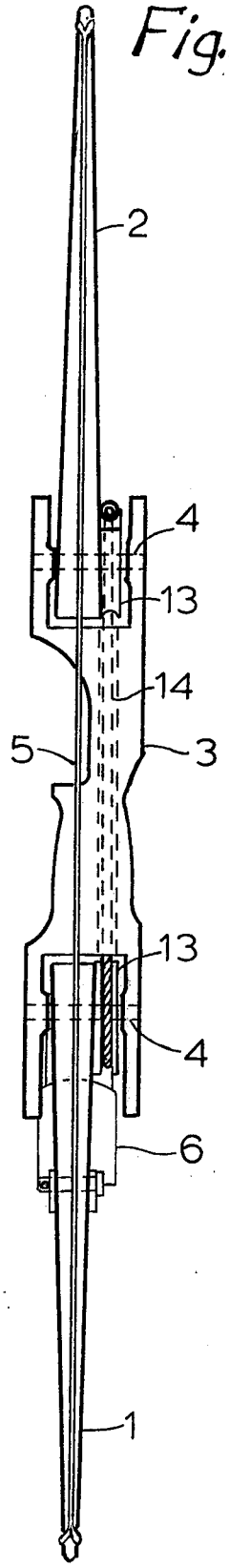
FIG. 1A is a back view of the bow.

The invention will be more clearly understood from the following detailed description read in conjunction with the accompaning drawings wherein: FIG. 1 illustrates one configuration of the invention. Master bow limb 1 and slave bow limb 2 are pivoted to the handle 3 by the shafts and bearings 4. The tips of the bow limbs are connected together by a bow string 5. A gas spring 6 is attached to the handle section and is made up of a piston 7 and a cylinder 8 which has a gas precharge in it. This spring is connected to the master bow limb 1 through a ratio changing linkage consisting of a spring rod 9, a rocking beam 10 and a link 11. The spring exerts a force on the master bow limb 1 in the direction of the arrow 12. The two bow limbs are connected together with a synchronizing system consisting of two pulley segments 13, which are fastened to the bow limbs 1 and 2, and a cable 14 running over the pulleys with the cable ends fastened to the pulleys or to the bow limbs. The spring force which is applied to the master bow limb 1 is thus divided between the master bow limb 1 and the slave bow limb 2 by the synchronizing pulleys 13 and cable 14. The bow limbs, being linked together, are forced to travel at identical velocities for maximum accuracy when shooting an arrow.

The precharge in the gas spring 6 can be altered through a fitting, not shown, in the air cylinder 8. The higher the precharge pressure, the higher the draw force will be. Other types of springs such as steel coil springs, cantilever springs or rubber springs can be used with this invention as will be shown in a subsequent example where use of a rubber shear spring is described with the aid of FIG. 6.

Figure 3:
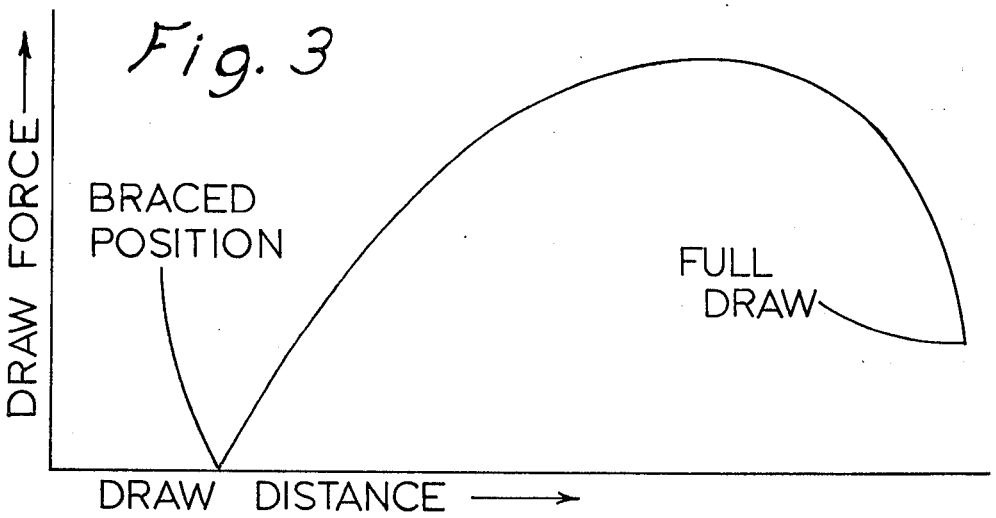
FIG. 3 is a graph showing the draw force/draw distance characteristics of the bow.

Still referring to FIG. 1, consider the bow string 5 to be drawn to the right from a spot near its center. The change in bow string and bow limb angles, the change in angles of the ratio changing mechanism parts 9, 10 and 11 and the increase in spring 6 force as the string is pulled will result in an increase in draw force as shown in the first portion of the draw force/draw distance graph of FIG. 3.

Figure 2:
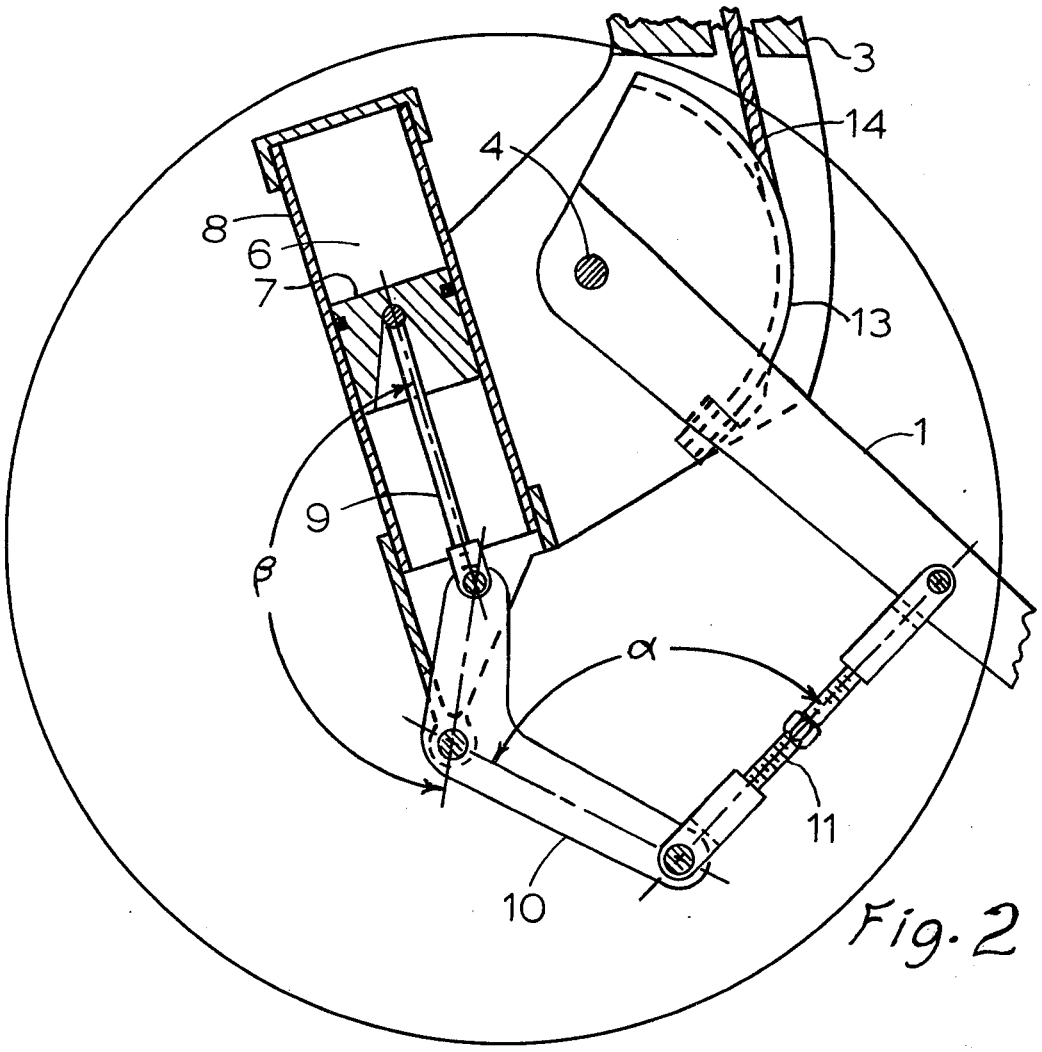
FIG. 2 is an enlarged view of the spring and ratio changing portion of the bow, shown near the full draw position.

FIG. 2 is an enlarged view of the circled area of FIG. 1 showing the relationship of the spring 6, master bow limb 1 and ratio changing parts 9, 10 and 11 as they appear near full draw of the bow. In this draw position the link 11 is at an angle $\alpha$ of near 90° with the lower end of the rocking beam 10 for near optimum transfer of torque from master bow limb 1 to the rocking beam 10. The other end of the rocking beam is at a very obtuse angle $\beta$ with the spring rod 9. This means that even though the spring is approaching its maximum deflection and force it is exerting less and less torque to the rocking beam 10 as the angle $\beta$ gets more and more obtuse. This change in linkage ratio results in a leveling off and eventually as a dropping off of bow draw effort as shown in the mid and latter portions of the draw force/draw distance graph of FIG. 3. In fact, if the bow string 5 is drawn back until angle $\beta$ is 180° then the draw force will have dropped to xero.

The link 11 of FIGS. 1 and 2 is preferably adjustable in length. If the link 11 is shortened the rocking beam 10 is effectively prerotated when the bow is in the braced position so that when the bow string 5 is pulled back, angle $\beta$ will approach 180° with a shorter draw distance. The draw force/draw distance graph for this adjustment of limb link 11 is illustrated by curve 15 of FIG. 4. If limb 11 is lengthened, the rocking beam 10 is prerotated in the oposite direction so that the bow string 5 must be pulled a longer distance before angle $\beta$ will approach 180°. The draw force/draw distance graph for this extended adjustment of limb link 11 is illustrated by curve 16 of FIG. 4.

Figure 4:
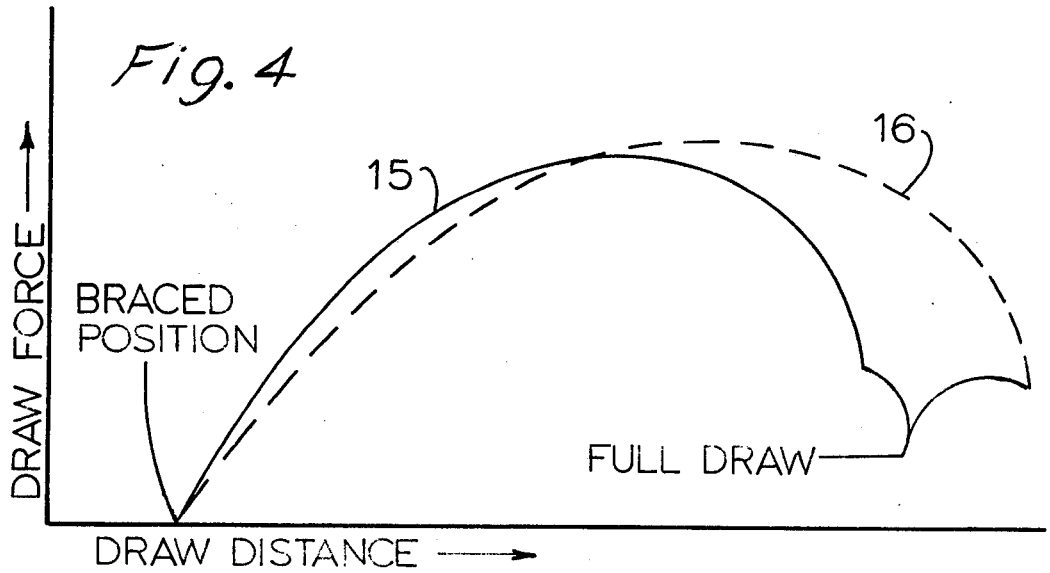
FIG. 4 is a graph show changes in draw force/draw distance characteristics possible with the adjustment means.
Figure 7:
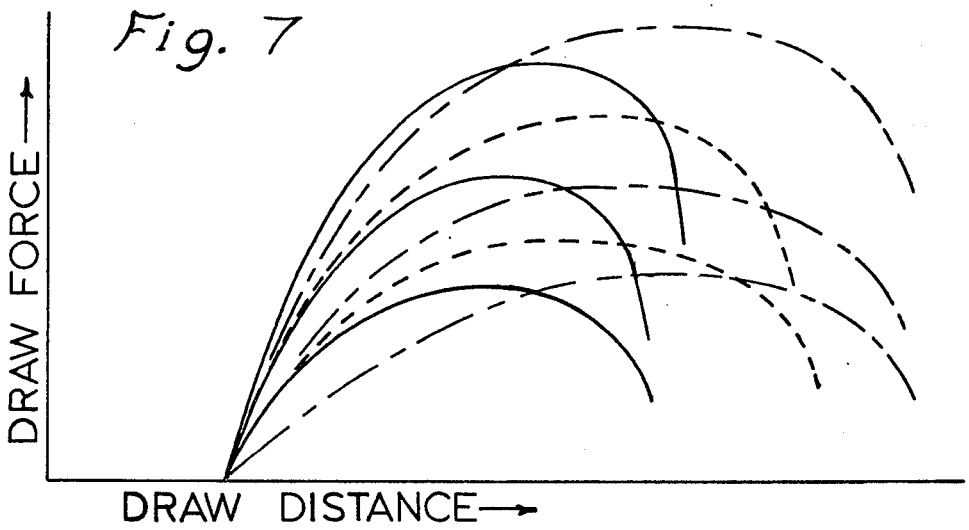
FIG. 7 is a graph illustrating a few of many performance curves which a bow of this invention can produce with the adjustments thereof.

It is obvious that curve 15 of FIG. 4 represents the type of draw distance requirements of a small short armed archer while curve 16 of that same figure represents the draw distance requirements of a long armed archer. Thus by changing the draw force levels by altering characteristics of the single spring and by altering draw distance parameters by prerotating the single ratio changing mechanism, a single bow can be adjusted to fit a child or a strong adult. FIG. 7 shows a few of the performance curves possible using a single bow of the type described.

Figure 5:
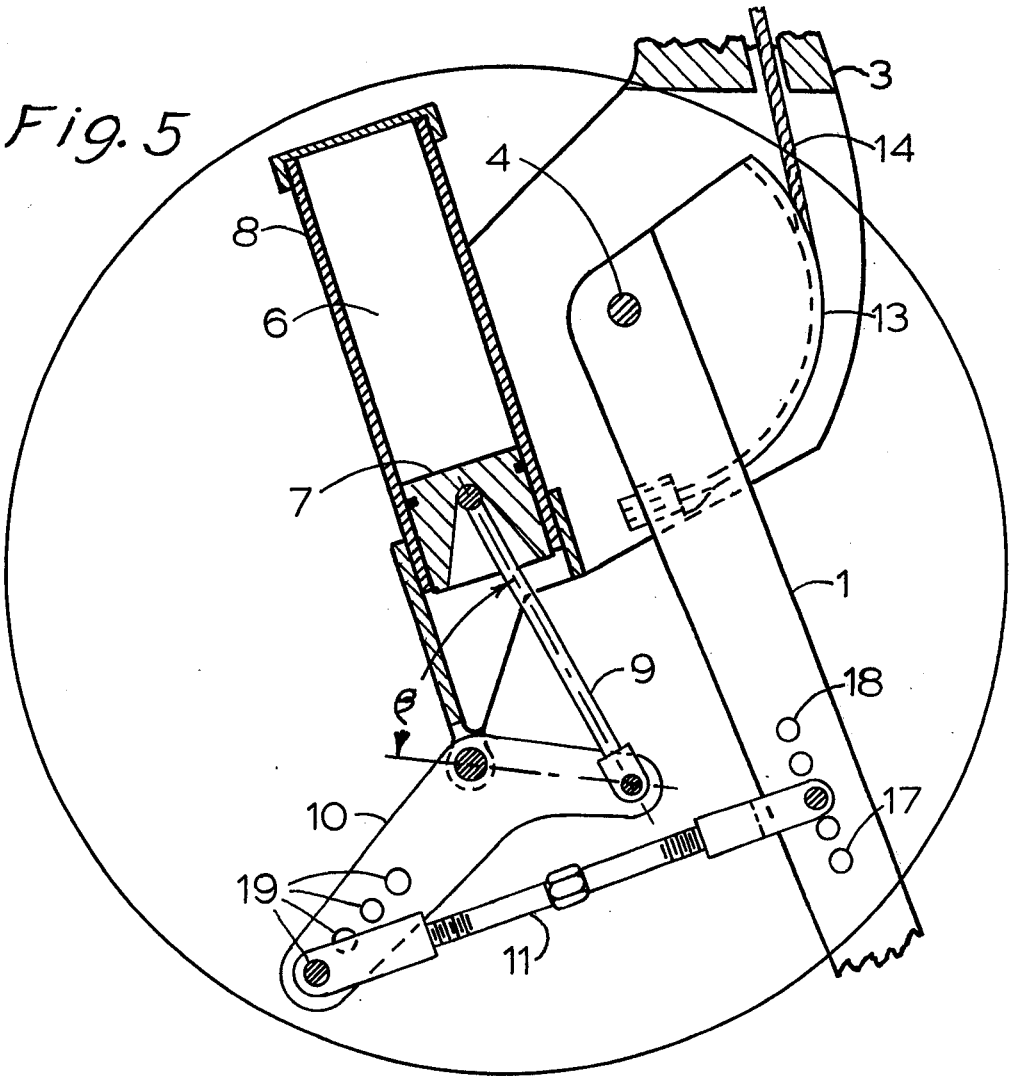
FIG. 5 is an enlarged view of the spring and ratio changing section of the bow showing alternate means of modifying draw characteristics.

Rather than making limb link 11 adjustable in length, somewhat similar changes in draw force/draw distance characteristics can be made by providing means to alter the mechanical advantage of the ratio changing linkage. Referring to FIG. 5 which is an enlarged view of the circled area of FIG. 1 with some modifications: if limb link 11 is attached to the master bow arm 1 at attachment point 17, rather than at attachment point 18, it is obvious, to those skilled in working with linkages, that the rocking beam 10 will rotate farther for a given draw distance. It is also obvious, that changing the mechanical advantage in this manner will also cause a significant change in draw force. With the ability to change draw force by changing spring characteristics it is again obvious that a change in mechanical advantage is a practical method of modifying the draw force/draw distance characteristics of a bow to enable it to suit the needs of most archers.

An alternate means of changing mechanical advantage of the ratio changing mechanism and means of prerotating the rocking beam is shown in the same FIG. 5. The rocking beam 10 is provided with several points of attachment 19 for the limb link 11. Judicious design of the shape of rocking beam 10 and the location of the attachment points 19 will permit wide variations in draw force and draw distance parameters.

Figure 6:
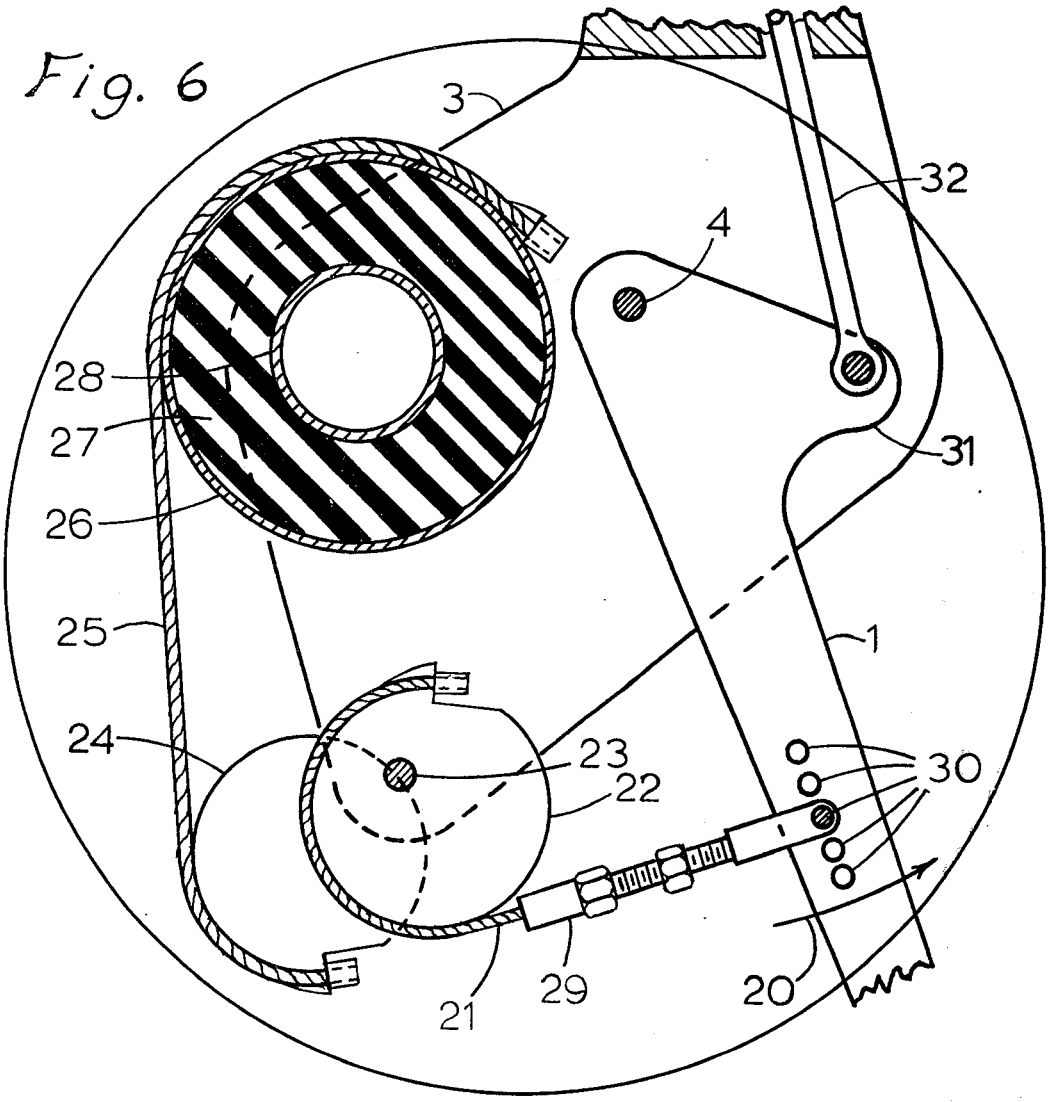
FIG. 6 is an enlarged view of the spring and ratio changing section of the bow illustrating the use of a different type of spring, ratio changing mechanism and synchronizer.

FIG. 6 is to illustrate that different types of springs, ratio changing mechanisms and synchronizers can be used and still maintain the basic and novel concept of a single spring, a single ratio changer and a single synchronizer. FIG. 6 is again a modification of the circled area of FIG. 1. As the master bow arm 1 is pulled back in the direction of arrow 20 it rotates about the pivot 4 and causes cable 21 to rotate pulley 22 counterclockwise around the pivot 23. Pulley 22 is attached to pulley 24 so that both pulleys rotate in unison. As pulley 24 rotates about pivot 23, cable 25 will cause cylinder 26, which is the outer periphery of the rubber shear spring 27, to rotate. The inner periphery of the rubber shear spring 27 is secured to a mounting member 28 which is securely attached to the bow handle section 3. The rubber of spring 27 is thus stressed in shear.

Pulleys 22 and 24 are eccentrically mounted and may be cam shaped in such a way as to change the mechanical advantage between the master bow limb 1 and the spring 27. This change in mechanical advantage is designed to provide draw force/draw distance characteristics similar to that shown in FIG. 3. The pulleys can be prerotated with the clevis 29 or the mechanical advantage of the linkage can be modified by attaching the clevis 29 to other positions on the master bow arm 1.

As explained previously these adjustments will modify the draw force/draw distance characteristics as shown in FIG. 4 and in FIG. 7.

Still referring to FIG. 6, the bow draw force can also be adjusted within moderate ranges by utilizing the optional clevis attachment positions 30. Gross changes in bow draw force can be provided by substituting a stronger or weaker spring in place of spring 27 or by substituting a modified set of pulleys in place of pulleys 22 and 24.

FIG. 6 also illustrates a modification of the synchronizer which was described in lines 8 to 18 of page 5. A lever arm 31 is attached to the master bow limb 1 and a link 32 is pivoted from this lever arm. The link is also provided to a similar lever arm (not shown) which is attached to the slave bow limb (not shown). As explained on page 5 with the aid of FIG. 1, this synchronizing linkage forces the two bow limbs to travel at identical velocities for precision in launching an arrow.

FIG. 7 illustrates the potential of changing bow draw force by changing the gas precharge pressure in the single air spring 6 or by exchanging the rubber shear spring made up of parts 26, and 27. It also shows the effect of adjusting the lengths of links 11 or 19 or of changing the mechanical advantage of the linkages in the ratio changing mechanisms. A single bow is capable of providing the characteristics of any of the curves shown in FIG. 7 or it can provide characteristics of hundreds of similar curves between and beyond those illustrated. The bow is truly a "Universal High Efficiency Archery Bow".

Although the invention has been described in terms of specified embodiments which are set forth in considerable detail, it should be understood that this is by way of illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

Having described the invention, what is claimed as new and desired to be secured by Letters Patent is:

1. An archery bow comprising:

a generally elongate central handle member having a pair of opposed end portions, a master bow limb pivotally attached to the central handle member adjacent one end portion thereof, a slave bow limb pivotally attached to the central handle member adjacent the other end portion thereof, only one single elongate tension means extending through the elongate central handle member and provided with a pair of opposed free end portions and having one free end portion secured to the master bow limb and having the other end portion secured to the slave bow limb for synchronizing pivotal movement of the limbs, the tension means extending between the master bow limb and the slave bow limb.

single spring means for exerting a force through one of said bow limbs in opposition to a drawing force on the bow limbs by a user, means attaching the single spring means to the central handle member, for support thereby, linkage means connecting the spring means only to the master bow limb, for operation therewith, and a bow string connected to the limbs adjacent a portion thereof which is spaced from the central handle member.

2. A bow of claim 1 wherein said spring comprises a rubber shear spring.

3. A bow of claim 2 wherein said rubber shear spring is interchangeable with a similar rubber shear spring of different preload and/or rate to suit the desires of the archer.

4. The archery bow of claim 1 in which the linkage means is adjustable to change the force/draw distance characteristics of the bow.

5. The archery bow of claim 1 in which the spring means is an air spring device.

6. The archery bow of claim 1 in which the spring means includes a body of resilient material.

7. The archery bow of claim 6 in which the link is adjustable in length to change the force/draw distance characteristics of the bow.

8. The archery bow of claim 1 in which the linkage means comprises a rocking beam having a pair of opposed portions and a central portion, means pivotally attaching the central portion of the rocking beam to the central handle member, a spring rod having a first end portion pivotally attached to the spring means, the spring rod also having a second end portion pivotally attached to the rocking beam at one of said opposed portions thereof, a link having a first end portion pivotally attached to the rocking beam at the opposite portion thereof, the link also having a second end portion pivotally attached to the master bow limb.

9. The archery bow of claim 8 in which the pivotal attachment position of the first end portion of the link is adjustably movable with respect to the rocking beam.

10. The archery bow of claim 8 in which the pivotal attachment position of the second end portion of the link is adjustably movable with respect to the master bow limb.

11. The archery bow of claim 1 in which the spring means includes a fluid housing and a piston movable therein.

12. The archery bow of claim 1 in which the linkage means includes a dual eccentric pulley member pivotally connected to the central handle member, a first flexible member joined to the spring means and to the dual eccentric pulley member to transfer torque between the spring means and the dual eccentric pulley member, a second flexible member joined to the dual eccentric pulley member and to the master bow limb to transfer torque between the dual eccentric pulley member and the master bow limb.

13. An archery bow of the type having a central handle portion and a pair of opposed limbs pivotally joined to the central handle portion, there being a first limb and a second limb, a bow string attached to the remote ends of the opposed limbs and extending therebetween, the improvement comprising:

only one single elongte synchronizing tension means extending through the central handle portion and having a pair of end portions, one end portion of the synchronizing tension means being attached to the first limb and the other end portion of the synchronizing tension means being attached to the second limb, single spring means for exerting a force through one of said bow limbs in opposition to a drawing force in the bow limbs by a user, means attaching the single spring means to only the first limb for transmitting a force developed by the spring means for resisting pivotal movement of the first limb, the second limb being movable only as influenced by forces applied thereto by the bow string and by forces applied thereto by the synchronizing tension means during movement of the first limb.

* * * * *

UNITED STATES PATENT OFFICE

CERTIFICATE OF CORRECTION

Patent No. 4,041,927 Dated August 16, 1977

Inventor(s) Robert M. Van House

It is certified that error appears in the above-identified patent and that said Letters Patent are hereby corrected as shown below:

ABSTRACT Line 9, change "include" to ---includes---.

Column 1, line 52, change "changeing" to ---changing---.

Column 2, line 4, change "for" to ---of---.

Column 2, line 19, change "show" to ---showing---.

Column 4, line 46, change "provided" to ---pivoted---.

Column 5, line 34, after "spring" insert ---means---.

Column 6, line 37, change "elongte" to ---elongate---.

Column 6, line 46, change "in" to ---on---.

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*